US008418618B2

(12) United States Patent
Ahola et al.

(10) Patent No.: US 8,418,618 B2
(45) Date of Patent: Apr. 16, 2013

(54) METHOD AND APPARATUS FOR SMALL-CHARGE BLASTING

(75) Inventors: Erkki Ahola, Kangasala (FI); Veikko Räisänen, Nokia (FI)

(73) Assignee: Sandvik Mining & Construction Oy, Tampere (FI)

( * ) Notice: Subject to any disclaimer, the term of this patent is extended or adjusted under 35 U.S.C. 154(b) by 236 days.

(21) Appl. No.: 12/810,101

(22) PCT Filed: Dec. 16, 2008

(86) PCT No.: PCT/FI2008/050746

§ 371 (c)(1),
(2), (4) Date: Jun. 22, 2010

(87) PCT Pub. No.: WO2009/083642

PCT Pub. Date: Jul. 9, 2009

(65) Prior Publication Data

US 2010/0275801 A1 Nov. 4, 2010

(30) Foreign Application Priority Data

Dec. 27, 2007 (FI) ..... 20075962

(51) Int. Cl.
*F42D 3/04* (2006.01)
*E21B 7/00* (2006.01)

(52) U.S. Cl.
USPC ..... 102/313; 175/2; 299/13

(58) Field of Classification Search ..... 102/301, 102/313; 299/13; 175/2, 4.52, 4.56
See application file for complete search history.

(56) References Cited

U.S. PATENT DOCUMENTS

| | | | | |
|---|---|---|---|---|
| 3,721,471 | A | 3/1973 | Bergmann et al. | |
| 4,501,199 | A * | 2/1985 | Mashimo et al. | 102/313 |
| 4,508,035 | A | 4/1985 | Mashimo et al. | |
| 4,592,282 | A * | 6/1986 | Niemi et al. | 102/313 |
| 5,308,149 | A | 5/1994 | Watson et al. | |

(Continued)

FOREIGN PATENT DOCUMENTS

| | | |
|---|---|---|
| JP | 58111283 U | 7/1983 |
| JP | 58140600 A | 8/1983 |
| JP | 4124600 A | 4/1992 |
| WO | 2006/099637 | 9/2006 |

OTHER PUBLICATIONS

Finnish Office Action dated Nov. 17, 2008.
Finnish Office Action dated Oct. 14, 2009.
International Search Report dated Apr. 2, 2009.

(Continued)

*Primary Examiner* — James Bergin
(74) *Attorney, Agent, or Firm* — Morgan, Lewis & Bockius LLP

(57) ABSTRACT

A method of small-charge blasting, a rock drilling unit and a front guide to be used therein. By means of a rock drill machine provided in the rock drilling unit, a hole is first drilled into a material to be excavated and, subsequently, a drilling tool is pulled out of the hole. Next, one or more propellants comprising a propellant charge are fed to the bottom of the hole through a propellant feed channel provided in connection with a feed beam. Then, the hole is sealed and the propellant is ignited, whereupon a high gas pressure is generated, which causes fractioning in the material to be excavated. During the feeding and ignition of the propellant, the rock drill machine is kept in a parallel direction with respect to the hole.

5 Claims, 4 Drawing Sheets

U.S. PATENT DOCUMENTS

| | | | | |
|---|---|---|---|---|
| 5,803,551 | A * | 9/1998 | McCarthy | 299/13 |
| 6,318,272 | B1 * | 11/2001 | Mey | 102/302 |
| 7,942,481 | B2 * | 5/2011 | Leppanen | 299/13 |
| 2008/0236433 | A1 * | 10/2008 | Leppanen | 102/313 |

OTHER PUBLICATIONS

Japanese Office Action (Application No. 2010-540152) dated Apr. 24, 2012, with English translation.

* cited by examiner

METHOD AND APPARATUS FOR SMALL-CHARGE BLASTING

BACKGROUND OF THE INVENTION

The invention relates to a method of small-charge blasting, the method comprising drilling, by a rock drill machine, a hole into a material to be excavated, and feeding, after drilling, at least one propellant comprising a propellant charge into the hole by means of a drilling unit. After this, the hole is also sealed before the propellant is ignited. The ignition of the small-charge generates a high gas pressure in the hole, which causes fracturing in the material to be excavated.

The invention further relates to a rock drilling unit for small-charge blasting. The drilling unit comprises a feed beam, a front guide provided in a front part of the feed beam, a rock drill machine, a drilling tool connected with the rock drill machine, and a propellant feed channel which enables a propellant comprising a propellant charge to be fed into a hole formed by the rock drill machine and the drilling tool. The invention still further relates to a front guide which is located in a front part of a feed beam and through which a drilling tool is arranged.

The field of the invention is defined in closer detail in the preambles of the independent claims.

In small-charge blasting, a propellant comprising a propellant charge or a corresponding small-charge is arranged in a hole. Upon ignition of the propellant, a high gas pressure is generated in the hole. The high pressure in the hole causes controlled fracturing in the material to be drilled. An advantage of the small-charge blasting over the conventional explosive blasting is that it is not necessary to move the rock drill machine away from the drilling location for post-drilling ignition, which means that the blasting may be continuous. Further, no strong stress waves are generated in small-charge blasting, wherefore a part of a rock which is not to be broken remains intact and requires no support. In addition, small-charge blasting is safer and it generates less dust.

U.S. Pat. No. 5,308,149 discloses a drilling unit comprising a rock drill machine and a cartridge insertion device which can be indexed by a feed beam. First, a hole is drilled by using the rock drill machine and, subsequently, the cartridge insertion device is indexed to be at the hole for inserting cartridges into the hole. The cartridge insertion device comprises a massive stemming bar by means of which the cartridge is pushed to the bottom of the drilled hole and by means of which the bottom of the hole is also sealed. WO 2006/099 637 discloses an alternative arrangement for small-charge blasting. Besides a rock drill machine, no separate cartridge insertion device is required but cartridges are fed by means of pressurized water to the shank of the rock drill machine and further through the drill rods to the drill bit, wherefrom they are led to the bottom of the hole. A disadvantage of this solution is that the blasting requires custom-made drill rods and drill bits which are to be dimensioned so as to enable the cartridges to be led therethrough.

BRIEF DESCRIPTION OF THE INVENTION

An object of the present invention is to provide a novel and improved method and drilling unit for small-charge blasting. A further object is to provide a novel and improved front guide.

A method according to the invention is characterized by pulling, after drilling, the drilling tool out of the hole; and feeding the propellant from a propellant feed channel provided in the drilling unit into the hole without indexing the drilling tool away from an axial line of the hole.

A drilling unit according to the invention is characterized in that the propellant feed channel is a separate member with respect to the drilling tool; and that the propellant feed channel is arranged in a front part of the feed beam.

A front guide according to the invention is characterized in that the front guide comprises at least one connector fitting connected with the space; that the connector fitting is connectable to a propellant feed channel for feeding a propellant comprising a propellant charge into a hole; and that the space is dimensioned to receive the drilling tool such that in a return direction of drilling, an outermost end of the drilling tool is movable past the connector fitting, whereby an open connection is provided from the connector fitting to a front side of the drilling tool.

The idea underlying the invention is that after drilling, the propellant is fed from a propellant feed channel, which is separate with respect to the tool, into the hole. Further, the rock drill machine and the drilling tool are kept on the axial line of the hole during the feeding of the propellants.

An advantage of the invention is that the very ordinary rock drilling tools can be used in the drilling since the propellant is not led through the tool. Consequently, no specially-dimensioned drill rods or drill bits are needed.

The idea of an embodiment is that the propellant feed channel is arranged in connection with the front guide.

The idea of an embodiment is that the outermost end of the propellant feed channel is pushed to the bottom of the hole and, subsequently, the propellant is fed into the hole. However, the propellant feed channel is pulled out of the hole before the propellant is ignited. The propellant feed channel may be a flexible tube or the like which is movable in a feed direction and in a return direction by means of an appropriate transfer device.

The idea of an embodiment is that after drilling, the drilling tool is pulled outwards to an extent sufficient for a free connection to open from the propellant feed channel provided in a front part of the feed beam to the bottom of the hole. The propellant is pushed to the bottom of the hole e.g. by means of pressurized water.

The idea of an embodiment is that after drilling, the drilling tool is pulled outwards to an extent sufficient for a free connection to open from the propellant feed channel provided in the front part of the feed beam to the bottom of the hole. Then, the propellant is fed from the propellant feed channel to a front side of the tool and, subsequently, the propellant is pushed to the bottom of the hole by means of the drilling tool.

The idea of an embodiment is that water is fed to the hole through the drilling tool so as to seal the hole. Alternatively, water is fed to the hole through the propellant feed channel so as to seal the hole. It is also possible to feed the sealing water by means of both the drilling tool and the propellant feed channel.

The idea of an embodiment is that the drilling tool is pushed back into the hole for the duration of the ignition of the propellant. This enables the drilling tool to participate in the sealing of the hole.

The idea of an embodiment is that the drilling tool is kept outside the hole during the ignition of the propellant.

The idea of an embodiment is that the front guide provided in the front end of the feed beam comprises first sealing members enabling the front guide to be arranged in a substantially sealed manner against the material to be excavated. The front guide further comprises an axial space through which the drilling tool is arranged. The propellant feed channel is connected with the axial space of the front guide. After the drilling tool has been pulled out of the hole in the return direction past the propellant feed channel, a free connection is provided from the propellant feed channel to the bottom of the hole. This enables the propellant to be fed to the front side of the tool and to be pushed into the hole by means of the drilling tool or, alternatively, the propellant may be pushed into the hole by feeding pressurized water from the propellant feed channel. The axial space may be sealed to the drilling tool at least for the duration of the feeding of the propellants.

The idea of an embodiment is that the drilling unit comprises ignition means for igniting the propellant.

BRIEF DESCRIPTION OF THE FIGURES

Some embodiments of the invention will be described in closer detail in the accompanying drawings, in which FIG. 1 schematically shows a rock drilling rig provided with drilling units according to the invention for small-charge blasting.

For the sake of clarity, the figures show some embodiments of the invention in a simplified manner. Like reference numerals identify like elements.

DETAILED DESCRIPTION OF SOME EMBODIMENTS OF THE INVENTION

Figure 1:
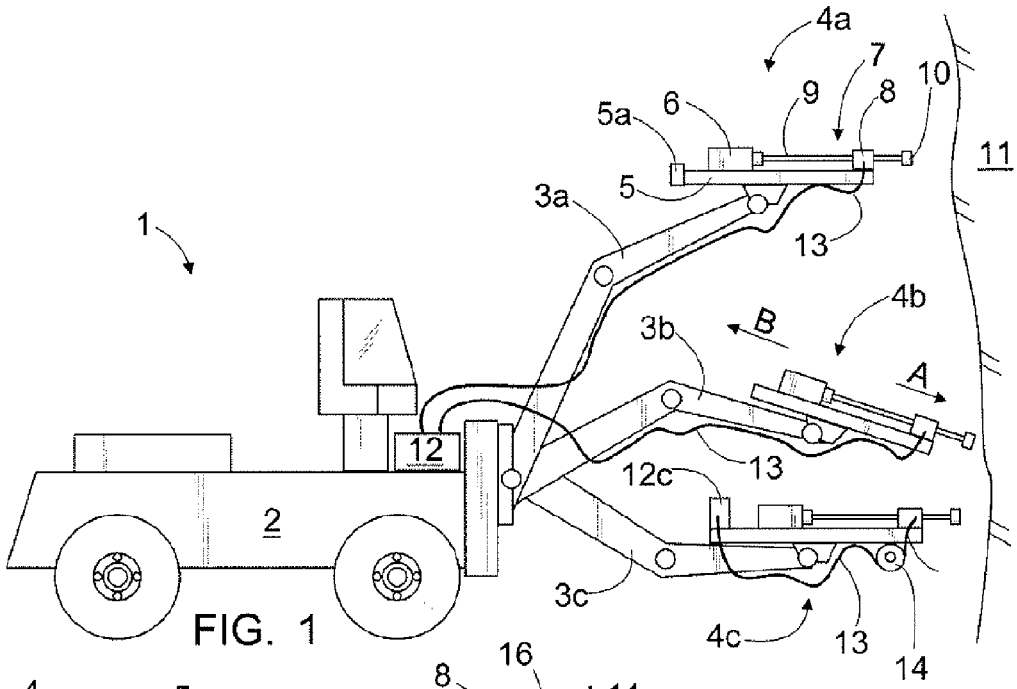

A rock drilling rig 1 shown in FIG. 1 comprises a movable carrier 2, three drilling booms 3*a* to 3*c*, and drilling units 4*a* to 4*c* mounted on each drilling boom. A drilling unit 4 comprises at least a feed beam 5, a rock drill machine 6, a feed device 5*a* for moving the rock drill machine 6 on the feed beam in a feed direction A and in a return direction B, and further, a drilling tool 7 connected with the rock drill machine 6, and a front guide 8 which is provided in a front part of the feed beam 5 and through which the drilling tool 7 is arranged. The drilling tool 7 may comprise one or more drill rods 9 and a drill bit 10 arranged in an outmost end of the tool. Alternatively, the drilling tool 7 may be an "integrated rod" whose outermost end is provided with bits or the like. The drilling tools, i.e. the drill rod 9 and the drill bit 10 or, alternatively, the integrated rod, is provided with one or more flushing agent channels which are dimensioned according to a flushing agent feed demand. The rock drill machine 6 may be a percussion drill machine provided with a percussion device for generating impact pulses on the drilling tool and for forwarding them through the tool to the rock or a corresponding material 11 to be excavated. Such a percussion rock drill machine may comprise a rotation device for rotating the drilling tool around its longitudinal axis. Alternatively, the rock drill machine may be non-percussive, in which case the drilling takes place by means of rotational movement only. As far as the basic idea of the invention is concerned, the drilling technique used for drilling a hole is irrelevant. The propellants used in small-charge blasting may be fed from a propellant magazine 12, provided on the carrier 2, along a feed channel 13 to the front guide 8 and further into the hole in any of the manners to be shown in FIGS. 2 to 10 below. Alternatively, a propellant magazine 12*c* may be located in connection with the drilling unit 4. It is also feasible that the feed channel 13 is a flexible member, such as a flexible tube, and that a drilling unit 3*c* comprises one or more transfer devices 14 enabling the feed channel 13 to be fed via the front guide 8 into the hole in a manner shown in FIG. 3.

Figure 2:
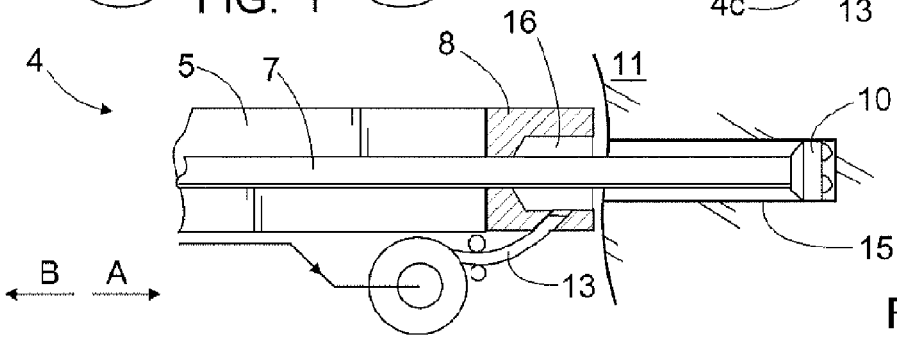
FIGS. 2 to 4 are schematic top views showing an embodiment of the invention wherein a propellant feed channel is pushed into a hole in order to feed a propellant to the bottom of the hole.
Figure 3:
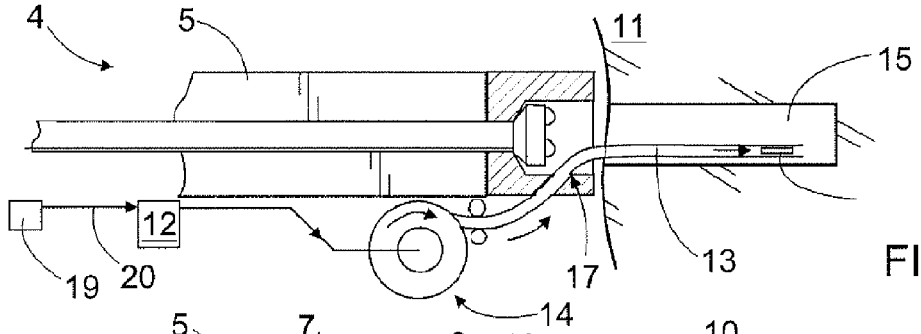
Figure 4:
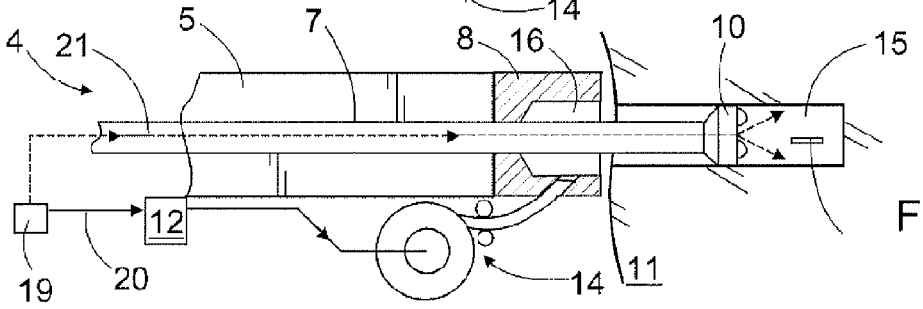

FIGS. 2 to 4 are top views showing an embodiment of a rock drilling unit. As shown in FIG. 2, a hole 15 is drilled in an ordinary manner by means of a rock drill machine and a tool 7 connected thereto. The tool 7 is arranged through a front guide 8 which is provided in a front end of a feed beam 5 and which supports the tool 7. The front guide 8 may be provided with a space 16 which is axial with respect to the feed beam 5 and which may receive a drill bit 10 or the like located in a front end of the tool 7 when the tool 7 is pulled out of the hole 15 in the return direction B, as shown in FIG. 3. The tool 7 is pulled axially in the return direction B at least to an extent in the return direction B sufficient for the tool 7 to move away past a connector fitting 17 of a feed channel 13 provided in the front guide 8. This enables a free connection to be provided from the feed channel 13 to the bottom of the hole 15. Hence, the rock drill machine 6 and the tool 7 do not have to be indexed away from the hole but they are only moved by a simple movement in the axial direction. In addition, the drilling tool 7 is not removed after drilling but it is kept connected with the rock drill machine 6 on the drilling line. After this, the flexible feed channel 13 may be pushed by a transfer device 14 via the connector fitting 17 to the bottom of the hole 15. The feed channel 13 or at least the outermost part thereof may consist of a flexible tube or the like. The transfer device 14 may be provided with one or more reels on which the flexible tube can be wound and from which it can be fed into the hole by means of a rotator motor or the like. The transfer device may be further provided with necessary guide or winding-up rollers for handling the feed channel 13. The feed channel 13 is connected with a propellant magazine 12 from which one or more propellants 18 may be fed by means of pressurized water to the bottom of the hole 15, whereto a free end of the feed channel 13 has been pushed. The pressurized water may be fed from a pressure source 19 via a flushing agent channel 20 to the propellant magazine 12 and further via the feed channel 13 into the hole 15. Alternatively, the propellant may be fed via the feed channel 13 by means of pressurized air or another pressure medium or even by means of an appropriate pushing device, such as a wire. After the propellant 18 has been fed, the bottom of the hole may be filled with water by feeding water from the feed channel 13. After the propellants have been fed and the bottom of the hole has been filled, the feed channel 13 may be pulled out of the hole. Alternatively, the hole may be sealed with water and physically stemmed by means of the drilling tool 7. The tool 7 may be pushed into the hole 15 to a desired distance from the bottom of the hole, as shown in FIG. 4. Next, water may be fed through flushing agent channels 21 of the tool 7 for sealing and filling the bottom of the hole. When water is fed by means of the tool 7 or the feed channel 13 arranged in the hole 15, the front guide 8 does not necessarily have to be provided with sealing means. When water is fed to the bottom of the hole, possible cracks in the rock are filled and the hole is sealed. In addition, the pressure generated by the propellant is transmitted to the rock through the water.

Figure 5:
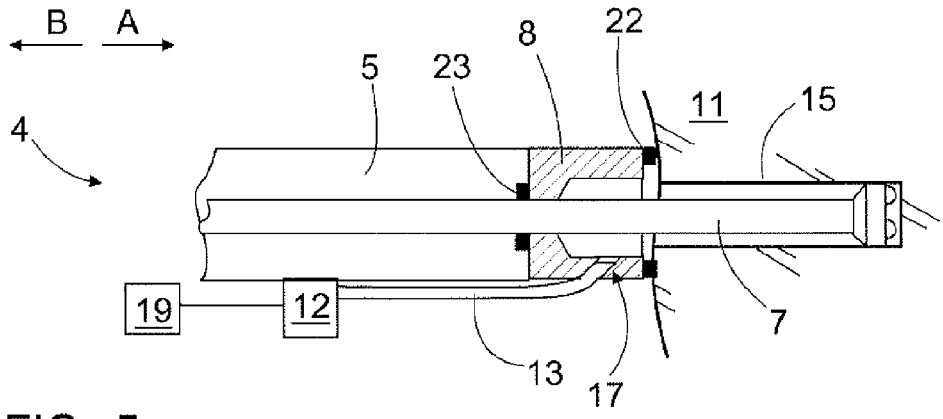
FIGS. 5 to 7 are schematic top views showing another embodiment of the invention wherein the propellant is fed from the propellant feed channel to a front side of a drilling tool and pushed to the bottom of the hole by means of pressurized water.
Figure 6:
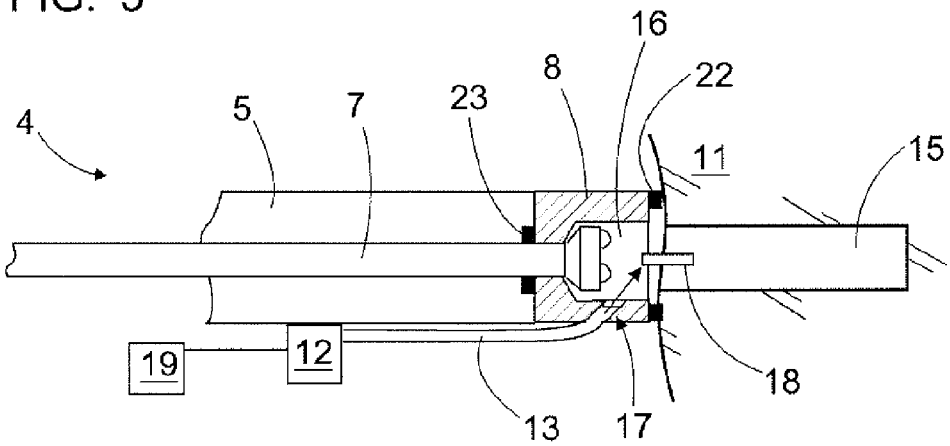
Figure 7:
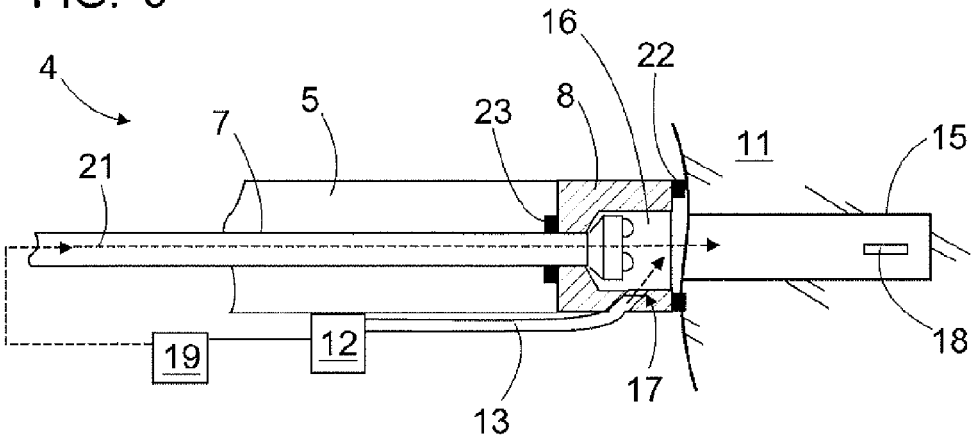

The drilling unit 4 shown in FIGS. 5 to 7 comprises no transfer device but therein the feed channel 13 is connected immovably to the fitting 17 provided in the front guide 8. The feed channel 13 may be a tube, a flexible tube or any appropriate channel. A front part of the front guide 8 may be provided with first sealing members 22 which enable the axial space 16 of the front guide to be sealed against the material 11 to be excavated. Further, second sealing members 23 may be provided between the tool 7 and the front guide 8. It is also feasible that the drill bit 10 becomes sealed to the axial space 16 e.g. by means of a conical surface after the tool 7, after drilling, has been pulled backwards in the return direction B into a position shown in FIG. 6. After drilling, one or more propellants 18 may be fed from the feed channel 13 to a front side of the tool 7 by means of pressurized water. The propellant 18 may be pushed further to the bottom of the hole 15 by means of pressureized water to be fed either from the feed channel 13 or from the flushing agent channel 21 of the tool 7, as shown in FIG. 7. The tool 7 may be kept in the space 16 during the ignition of the propellant 18 or it may be pushed into the hole 15.

Figure 8:
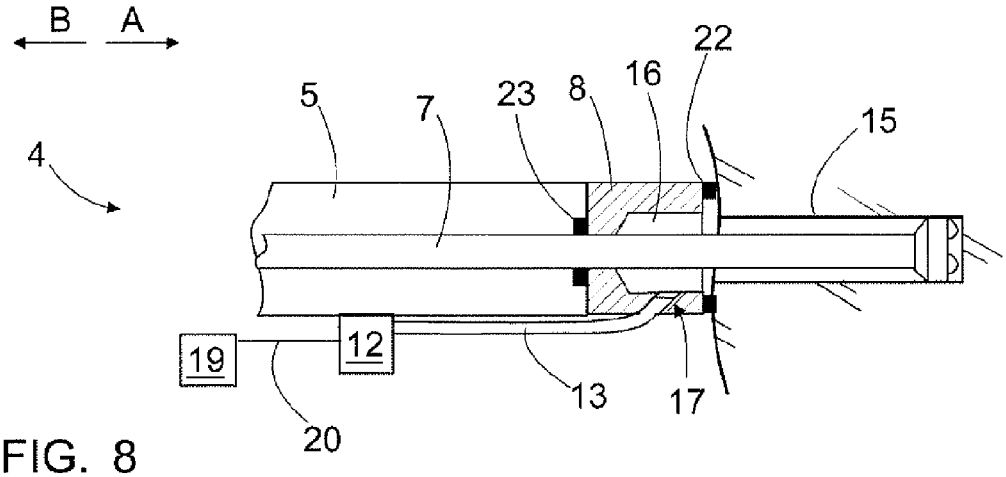
FIGS. 8 to 10 are schematic top views showing a third embodiment of the invention wherein the propellant is fed from the propellant feed channel to the front side of the drilling tool and pushed to the bottom of the hole by means of the drilling tool.
Figure 9:
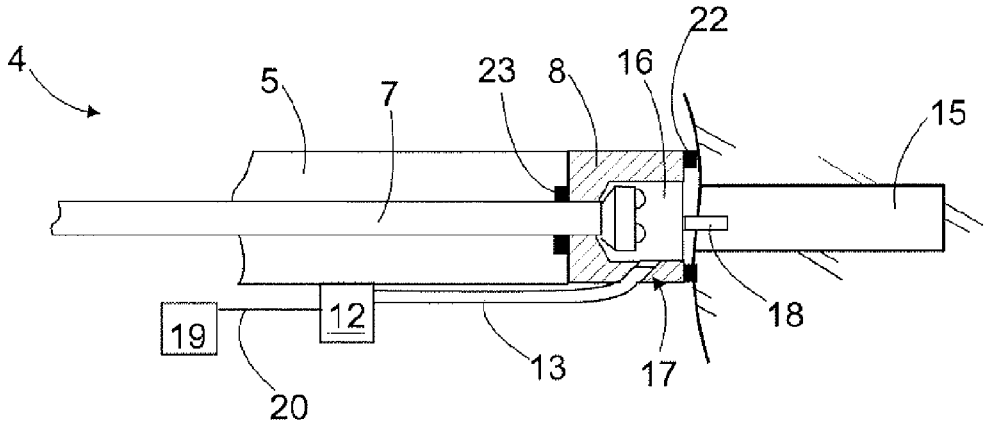
Figure 10:
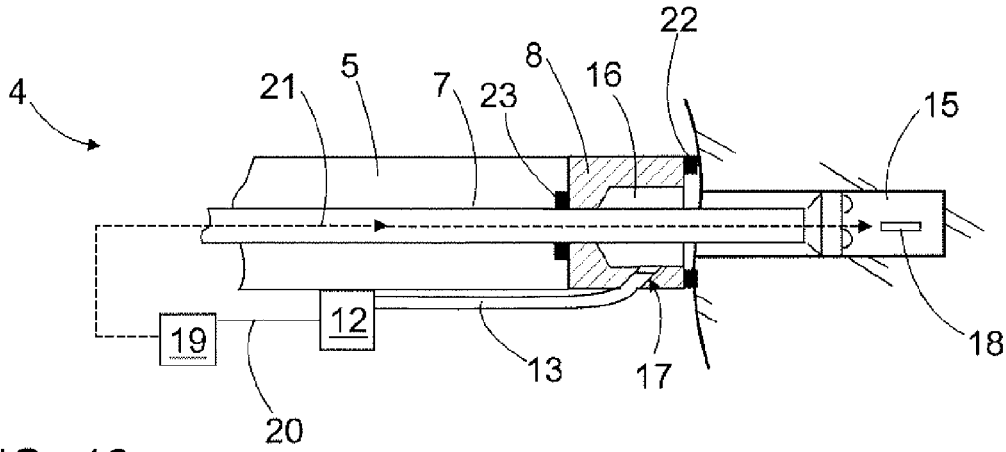

The arrangement shown in FIGS. 8 to 10 differs from that shown in FIGS. 5 to 7 in that the propellant 18 fed from the feed channel 13 to the front side of the tool 7 is pushed to the bottom of the hole 15 by means of the tool 7. This makes it possible to ensure that the propellant 18 is situated in the hole 15 as desired. The tool 7 may be set at a predetermined distance from the bottom of the hole and, subsequently, the bottom of the hole is filled and sealed by feeding pressurized water from the flushing agent channel 21 of the tool.

Figure 11:
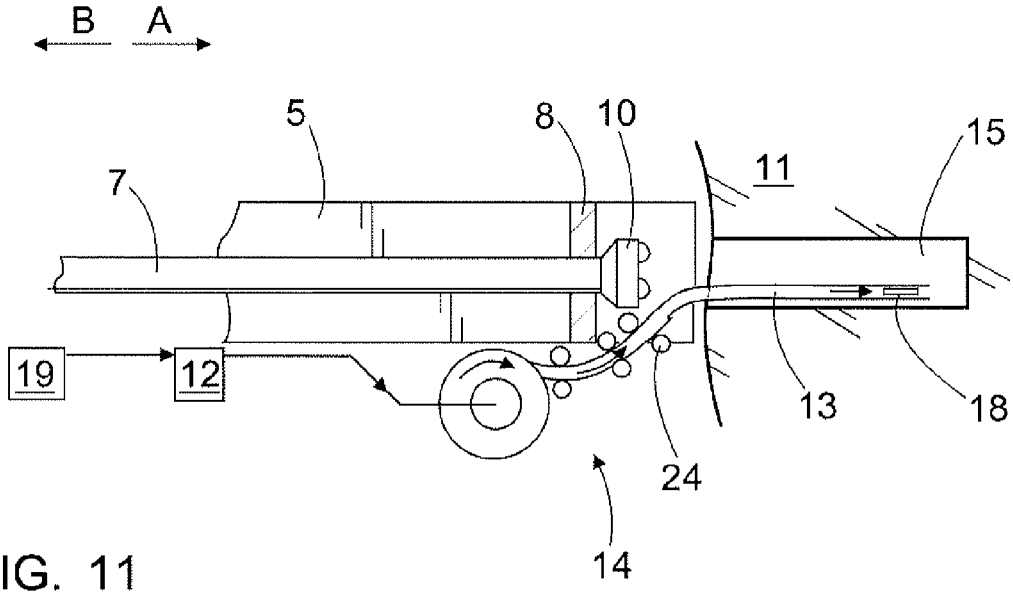
FIG. 11 is another schematic top view showing an embodiment of the rock drilling unit.

FIG. 11 shows an embodiment wherein the front guide 8 is located at a distance from the front end of the feed beam 5. In such a case, the tool 7 and the drill bit 10 provided therein may be pulled in the return direction B into a section between the front end of the feed beam 5 and the front guide 8. The tool 7 is pulled axially in the return direction B past guide members 24, such as rollers or the like and, subsequently, the flexible feed channel 13 may be pushed by means of the transfer device 14 into the hole 15 for feeding the propellant 18. In this embodiment, the feed channel 13 is not led through the front guide 8, so the structure of the front guide may be simple. It needs e.g. no axial space 16 for the drill bit, or no fitting 17 for the feed channel 13. The front guide 8 may be a standard component.

After the propellant 18 has been fed and the hole 15 has been sealed, the propellant 18 may be ignited by giving an ignition impulse by means of an ignition device or the like. The propellant 18 may be provided with a pressure-sensitive igniter, in which case it may be ignited by giving, by the ignition device, a pressure impulse to the fill water surrounding the propellant. On the other hand, the ignition device may, via the drilling tool 7, give a mechanical impulse to the igniter of the propellant 18, or the igniter may be ignitable by electromagnetic waves or impulses. The ignition device may be arranged in the drilling unit 4. If electromagnetic waves are used for ignition, the ignition device may be external to the drilling unit and the ignition may take place remote-controllably, e.g. from the control cabin of the rock drilling rig.

As shown in the figures, the drilling tool 7 is kept connected with the rock drill machine 6 also during the feeding of the propellants. This enables, if desired, the drilling tool 7 to be used for pushing the propellants into the hole and sealing the hole. In addition, the drilling tool is ready for drilling the next hole.

In some cases, the features disclosed in the present invention may be used as such, irrespective of other features. On the other hand, the features disclosed in the present invention may be combined, when necessary, so as to provide various combinations.

The drawings and the related description are only intended to illustrate the idea of the invention. The details of the invention may vary within the scope of the claims.

The invention claimed is:

1. A rock drilling unit for small-charge blasting, the drilling unit comprising:

a feed beam;

a rock drill machine;

a feed device which enables the rock drill machine to be moved on the feed beam in a feed direction and in a return direction;

a drilling tool connected with the rock drill machine;

a front guide which is located in a front part of the feed beam and through which the drilling tool is arranged; and a propellant feed channel which enables a propellant comprising a propellant charge to be fed into a hole, wherein the propellant feed channel is a separate member with respect to the drilling tool, wherein the propellant feed channel is arranged in the front part of the feed beam, wherein the propellant feed channel is a flexible tube, and wherein the drilling unit comprises at least one transfer device which enables the propellant feed channel to be pushed into the hole for feeding the propellant and further, the transfer device enabling the propellant feed channel to be pulled back out of the hole after the propellant has been fed.

2. The drilling unit as claimed in claim 1, wherein the propellant feed channel is arranged in connection with the front guide.

3. The drilling unit as claimed in claim 1, wherein:

the front guide comprises first sealing members which enable the front guide to be arranged in a substantially sealed manner against a material to be excavated;

the front guide comprises second sealing members for sealing the drilling tool with respect to an axial space of the front guide at least for the duration of the feeding of the propellants;

the propellant feed channel is connected with the axial space of the front guide by means of a fitting; and when the drilling tool is pulled out of the hole in a return direction past the fitting, a free connection is provided from the propellant feed channel to the bottom of the hole.

4. The drilling unit as claimed in claim 1, wherein the propellant feed channel is connected with a flushing agent channel, which enables pressurized water to be led through the propellant feed channel into the hole.

5. The drilling unit as claimed in claim 1, wherein the flexible feed channel is fed into the drill hole from a transverse direction relative to the axial line of the drill hole and the drilling tool.

* * * * *